US006740251B2

(12) United States Patent
Materniak et al.

(10) Patent No.: US 6,740,251 B2
(45) Date of Patent: May 25, 2004

(54) FLUORINATED TREATMENT FOR SOIL RESISTANCE

(75) Inventors: Joyce Monson Materniak, Hockessin, DE (US); Peter Michael Murphy, Ooltewah, TN (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 1 day.

(21) Appl. No.: 10/207,405

(22) Filed: Jul. 29, 2002

(65) Prior Publication Data

US 2004/0016901 A1 Jan. 29, 2004

(51) Int. Cl.[7] ..... D06M 15/00; D06M 15/256; D06M 15/564

(52) U.S. Cl. ..... 252/8.62; 252/8.61; 427/393.4

(58) Field of Search ..... 252/8.61, 8.62; 427/393.4

(56) References Cited

U.S. PATENT DOCUMENTS

| | | | | | |
|---|---|---|---|---|---|
| 3,923,715 | A | | 12/1975 | Dettre et al. | |
| 4,029,585 | A | | 6/1977 | Dettre et al. | |
| 4,140,709 | A | | 2/1979 | Szur | |
| 5,223,340 | A | | 6/1993 | Moss et al. | |
| 5,410,073 | A | | 4/1995 | Kirchner | |
| 5,411,766 | A | | 5/1995 | Kirchner | |
| 5,414,111 | A | * | 5/1995 | Kirchner | 560/357 |
| 5,509,939 | A | * | 4/1996 | Kirchner | 8/115.51 |
| 5,534,167 | A | | 7/1996 | Billman | |
| 5,565,564 | A | * | 10/1996 | Kirchner | 544/221 |
| 5,580,645 | A | * | 12/1996 | Kirchner | 442/80 |
| 5,672,651 | A | * | 9/1997 | Smith | 524/590 |
| 5,712,240 | A | | 1/1998 | Tyerech et al. | |
| 5,714,082 | A | | 2/1998 | Boardman et al. | |
| 5,728,669 | A | | 3/1998 | Tyerech | |
| 5,770,656 | A | | 6/1998 | Pechhold | |
| 5,827,919 | A | * | 10/1998 | May | 524/590 |
| 5,861,365 | A | | 1/1999 | Colurciello, Jr. et al. | |
| 5,948,480 | A | | 9/1999 | Murphy | |
| 6,048,952 | A | | 4/2000 | Behr et al. | |
| 6,117,353 | A | | 9/2000 | Dunsmore et al. | |
| 6,197,378 | B1 | | 3/2001 | Clark et al. | |
| 6,251,984 | B1 | | 6/2001 | Shimada et al. | |
| 6,479,612 | B1 | * | 11/2002 | Del Pesco et al. | 528/70 |

FOREIGN PATENT DOCUMENTS

| | | | |
|---|---|---|---|
| DE | 2528258 | A | 1/1977 |
| JP | 50148699 | A | 11/1975 |
| WO | WO/98 98/18892 | A | 5/1998 |
| WO | WO/01 01/75215 | A | 10/2001 |

OTHER PUBLICATIONS

Cleaning Challenges; http://www.carpetbuyershandbook.com/common_cleaning$_{13}$ challenges.htm, pp. 1–4.

Hoover Consumer Guide to Carpet Cleaning; http://www.hoovercompany.com/ftp/cguide.pdf, The Hoover Company; pp. 1–10.

Carpet & Rug Institute—Care & Cleaning—Facts About Carpet Care—Deep Cleaning; http://www.carpet–rug.com/drill_down_2.cfm?page=14&sub=3, pp. 1–4.

Scotchgard Protection—Carpet Care—Cleaning Section; http://cms.3m.com/cms/US/en/2–78/iFeRkFQ/view.jhtml; pp. 1–2.

DuPont Antron®/Maintain Your Carpet; http://antron.dupont.com/content/how_to/ant02_06.shtml; pp. 1–3.

* cited by examiner

*Primary Examiner*—Anthony J. Green

(57) ABSTRACT

A soil resist agent comprising a dispersion of a polyfluoro organic compound having a least one of a urea, urethane or ester linkage, and at least one anionic surfactant wherein the ratio of polyfluoro organic compound to surfactant is from about 0.075:1.0 to about 5:1 for treatment of fibrous substrates is disclosed.

15 Claims, No Drawings

FLUORINATED TREATMENT FOR SOIL RESISTANCE

BACKGROUND OF THE INVENTION

The following definitions are used by the American Association of Textile Chemists & Colorists (MTCC) in the AATCC Technical Manual, Vol. 77, pp. 409 and 413, 2002, American Association of Textile Chemists and Colorists, Research Triangle Park, NC. "Detergent" is a cleaning agent containing one or more surfactants as the active ingredient (s). "Soil" is dirt, oil, or other substances not normally intended to be present on a substrate, such as a textile material. "Soiling" in textiles is a process by which a textile substrate becomes more or less uniformly covered with, or impregnated with, soil. "Soil resist agent" is a material applied to, or incorporated in, carpet face fiber that retards and/or limits the build-up of soil. "Surfactant" is a soluble or dispersible material that reduces, the surface tension of a liquid, usually water.

The same source defines "Textile floor covering" as "an article having a use-surface composed of textile material and generally used for covering floors." Hereinafter the term "carpet" is used to describe such textile floor covering.

The Kirk-Othmer Concise Encyclopedia of Chemical Technology, 3rd Edition, John Wiley & Sons, New York N.Y., 1985 in a discussion of "Surfactants and Detersive Systems" at p. 1142 states "The term detergent is often used interchangeably with surfactant."

In the prior art, residual oils or detergents left on the fiber of a carpet after manufacture, after the application of soil resist agents, or after carpet cleaning by shampooing, have been extensively reported as causes of subsequent soiling. For instance, W. F. Taylor and H. J. Demas "The Why's of Carpet Soil", Textile Ind., November 1968, pp. 83–87 comment at p. 83–84: "Severe soiling may occur if the fiber contains an oily film. This phenomena is responsible for most resoiling problems after a carpet has been shampooed where the detergent is not completely removed. Improper lubricants on the fiber can cause this effect, as will airborne greases which settle onto the carpet surface." The authors equate oils and detergents as causes. The authors continue to list factors "thought to affect soiling of nylon carpets" and state (p. 87) "The effect of residual oily materials causing increased soiling of textile materials is well documented in the literature. Severe soiling may occur if the fiber contains an oily film." Elsewhere, W. Postman, in "Spin Finishes Explained", Textile Research Journal, Vol. 50 #7, 444–453 (July 1980), notes at p. 445, that " . . . since poor scourability can cause dyeing problems and potential soiling spots, lubricants must come off the yarn under mild scouring conditions . . . ."

Technical information for the carpet manufacturing trade is replete with warnings about the worsened soiling associated with, and attributed to, excessive amounts of oils or detergents. Current World Wide Web sites include:

Carpet Buyers Handbook web site (accessed Jul. 25, 2002):

"Often resoiling can be attributed to detergent residues left behind during cleaning. Detergents, by design, attract soil. By leaving detergent in carpet after cleaning, detergents rapidly attract soil."

Hoover Consumer Guide to Carpet Cleaning web site (accessed Jul. 25, 2002):

"Some shampoos contain oil which can contribute to resoiling; . . . "

Carpet and Rug Institute (CRI) web site (accessed Jul. 25, 2002):

"Rinse all detergent from the carpet to prevent accelerated resoiling."

3M web site (accessed Jul. 25, 2002):

"Shampooing may not only leave behind a soapy residue that often masks the carpet's protective finish, but it can attract and hold dirt."

DuPont Antron* web site, from Section C, Deep Cleaning (accessed Jul. 25, 2002):

"You also need to be aware that some methods use detergents that cause resoil. This happens when detergents remain on the fiber surface after cleaning. These detergents will continue to attract soil causing the carpet to look dirty."

The manufacturers of dispersed soil resist formulations have consequently striven to use only enough dispersing agent in their formulations to provide a stable dispersion in the formulation as shipped. The results of this restriction are shown in Table 1 as the ratio of fluorochemical to dispersant in typical commercial carpet soil resist formulations. The calculated weight ratio of fluorochemical:dispersing agent ranges from 14:1 to 30:1 in Table 1.

TABLE 1

Conventional Surfactant Ratios in Commercial Soil Resists.

| Prior Art Composition (Reference) | Fluoro-chemical Ingredient | Dispersant | Fluorochemical: Dispersant Ratio |
|---|---|---|---|
| Soil Resist 1[a] | 28% | 2% | 14:1 |
| Soil Resist 2[b] | 22.6% | 1.4% | 16:1 |
| Soil Resist 3[c] | 9.1% | 0.3% | 30:1 |
| Soil Resist FCT-3[d] | 201.6 g | 11 g | 18.3:1 |
| Soil Resist FCT-7[d] | 50 g | 2.5 g | 20:1 |
| Soil Resist FCT-8[d] | 50 g | 2.5 g | 20:1 |

[a]Soil Resist 1 is an anionically dispersed fluorinated polyurethane soil resist prepared according to Example 1 in U.S. Pat. No. 5,414,111.
[b]Soil Resist 2 is an anionically dispersed fluorinated polyurethane soil resist prepared according to Example 1 in U.S. Pat. No. 5,411,766.
[c]Soil Resist 3 is an anionically-dispersed blend of fluorinated soil resist, prepared according to Example 2 in U.S. Pat. No. 3,923,715, except that an equivalent amount of hexamethylene diisocyanate was used instead of 1-methyl-2,4-diisocyanatobenzene in the synthesis of the perfluoroalkyl citrate urethane. The citrate urethane was mixed with the poly (methylmethacrylate) latex as described in Example 2 therein.
[d]Soil Resists FCT-3, FCT-7, and FCT 8 are described in U.S. Pat. No. 5,714,082.

Typically, soil resist formulations are shipped in a concentrated form, and diluted with water at the site of application. Commercially, dispersing agent levels in such formulations are kept close to the minimum needed to assure dispersion stability during shipment, dilution, and use.

It is desirable to have improved soil resist agents for treatment of fibrous substrates such as carpets during manufacture, and for use in or after cleaning agents used on soiled carpets. Such an improved soil resist agent would provide better resistance to soiling.

The present invention comprises specific soil resist agents formulated in dispersions containing substantially more surfactants than are necessary to assure a stable dispersion. Despite teachings that residual oils or surfactants lead to quicker soiling of carpet, it has been found that increasing the level of surfactant present in the soil resist agent improves its performance.

SUMMARY OF THE INVENTION

The present invention is a soil resist agent comprising a dispersion in water or water and solvent of a) a polyfluoro organic compound having at least one of a urea, urethane, or ester linkage, and b) at least one anionic non-fluorinated surfactant, wherein the ratio of polyfluoro organic compound to surfactant is from about 0.075:1.0 to about 5:1.

The present invention further comprises a method of treating fibrous substrates for soil resistance comprising application to the fibrous substrates of a soil resist agent comprising a dispersion in water or water and solvent of a) a polyfluoro organic compound having at least one of a urea, urethane, or ester linkage, and b) at least one anionic non-fluorinated surfactant, wherein the ratio of polyfluoro organic compound to surfactant is from about 0.075:1.0 to about 5:1.

The present invention further comprises a carpet treated with a soil resist agent comprising a dispersion in water or water and solvent of a) a polyfluoro organic compound having at least one of a urea, urethane, or ester linkage, and b) at least one anionic non-fluorinated surfactant, wherein the ratio of polyfluoro organic compound to surfactant is from about 0.075:1.0 to about 5:1.

DETAILED DESCRIPTION

For the purposes of this invention, the term "dispersing agent" or "dispersant" is used to describe the surface active agent used to produce the stable dispersion of the soil resist agent, while the term "surfactant" is used to describe the additional anionic non-fluorinated surfactants used to enhance soil resist performance of the compositions of the present invention. It is recognized that the same anionic non-fluorinated surfactant may be used for both dispersant and surfactant functions.

The present invention is a soil resist agent comprising a dispersion of a) a polyfluoro organic compound having at least one of a urea, urethane, or ester linkage, and b) at least one anionic non-fluorinated surfactant, in water or water and solvent, wherein the ratio of polyfluoro organic compound to surfactant is from about 0.075:1.0 to about 5:1.

The improved soil resist agents of this invention comprise one or more polyfluoro organic compounds combined with at least one anionic non-fluorinated surfactant at a higher level than is needed to assure a stable dispersion. Table 1 shows the fluorochemical:dispersant ratios of the prior art are in the range 14:1 to 30:1.

Clearly, the choice of added surfactants must be based on compatibility with the polyfluoro organic compound and with any dispersants used.

Any anionic non-fluorinated surfactant or blend of surfactants is useful in the practice of the present invention. These include anionic non-fluorinated surfactants and anionic hydrotrope non-fluorinated surfactants, including sulfonates, sulfates, phosphates and carboxylates. Commercially available anionic non-fluorinated surfactants suitable for use in the present invention include a salt of alpha olefin sulfonate, salt of alpha sulfonated carboxylic acid, salt of alpha sulfonated carboxylic ester, salt of 1-octane sulfonate, alkyl aryl sulfate, salt of dodecyl diphenyloxide disulfonate, salt of decyl diphenyloxide disulfonate, salt of butyl naphthalene sulfonate, salt of $C_{16}$–$C_{18}$ phosphate, salt of condensed naphthalene formaldehyde sulfonate, salt of dodecyl benzene sulfonate, salt of alkyl sulfate, salt of dimethyl-5-sulfoisophthalate, and a blend of salt of decyl diphenyloxide disulfonate with salt of condensed naphthalene formaldehyde sulfonate. The sodium and potassium salts are preferred.

Preferred anionic non-fluorinated surfactants are the sodium or potassium salts of dodecyl diphenyloxide disulfonate, alkyl aryl sulfates, salt of alkyl sulfate, $C_{16}$–$C_{18}$ potassium phosphate, decyl diphenyloxide disulfonate, and a blend of decyl diphenyloxide disulfonate with condensed naphthalene formaldehyde sulfonate.

The anionic non-fluorinated surfactants are added in addition to the amount of dispersant or dispersants needed to disperse the polyfluoro organic compound. Specifically, the improved soil resist agents of this invention contain a fluorochemical organic compound having at least one urea, urethane, or ester linkage (hereinafter "fluorochemical" or "FC"). The fluorochemical to surfactant (the total of surfactant and dispersant) ratio is from about 0.075:1.0 to about 5:1, preferably from about 0.2:1 to about 4:1, and more preferably from about 0.1:1.0 to about 4:1. Such formulations contrast clearly with conventional soil resist formulations having fluorochemical:dispersant ratios of 14:1 to 30:1 by weight as described previously.

Any suitable fluorochemical organic compound having at least one urea, urethane, or ester linkage can be used herein. Fluorochemical compounds suitable for use in the soil resist agent compositions of the present invention include the polyfluoro nitrogen-containing organic compounds described by Kirchner in U.S. Pat. No. 5,414,111, incorporated herein by reference, and comprise compounds having at least one urea linkage per molecule which compounds are the product of the reaction of: (1) at least one organic polyisocyanate or mixture of polyisocyanates which contains at least three isocyanate groups per molecule, (2) at least one fluorochemical compound that contains per molecule (a) a single functional group having one or more Zerewitinoff hydrogen atoms and (b) at least two carbon atoms each of which contains at least two fluorine atoms, and (3) water in an amount sufficient to react with from about 5% to about 60% of the isocyanate groups in the polyisocyanate. A Zerewitinoff hydrogen is an active hydrogen [such as —OH, —COOH, —NH, and the like] contained in an organic compound. Zerewitinoff hydrogens may be quantified by reacting the compound with a $CH_3Mg$ halide to liberate $CH_4$, which, measured volumetrically, gives a quantitative estimate of the active hydrogen content of the compound. Primary amines give 1 mole of $CH_4$ when reacted in the cold; usually two moles when heated [Organic Chemistry by Paul Karrer, English Translation published by Elsevier 1938, page 135].

In a preferred embodiment, the amount of water is sufficient to react with about 10% to about 35% of the isocyanate groups in the polyisocyanate, and most preferably, between about 15% and about 30%.

A wide variety of fluorochemical compounds that contain a single functional group can be used so long as each fluorochemical compound contains at least two carbon atoms and each carbon atom is bound to at least two fluorine atoms. For example, the fluorochemical compound can be represented by the formula:

$$R^f—R_k—X—H$$

wherein:

$R^f$ is a monovalent aliphatic group containing at least two carbon atoms, each of which is bound to at least two fluorine atoms;

| | |
|---|---|
| R | is a divalent organic radical; |
| k | is 0 or 1; and |
| X | is —O—, —S—, or —N($R^1$)— in which $R^1$ is H, alkyl containing 1 to 6 carbon atoms or a $R^f$—$R_k$— group. |

For purposes of this invention, it is assumed that a primary amine provides one active hydrogen as defined by Zerewitinoff et al.

In a more specific embodiment, the fluorochemical compound that contains a single functional group can be represented by the formula:

$$R^f—R_k—X—H$$

wherein $R^f$ and k are as defined above;

R is the divalent radical: —$C_mH_{2m}SO$—, —$C_mH_{2m}SO_2$—, —$SO_2N(R^3)$—, or —$CON(R^3)$—in which m is 1 to 22 and $R^3$ is H or alkyl of 1 to 6 carbon atoms;

$R^2$ is the divalent linear hydrocarbon radical: —$C_nH_{2n}$—, which can be optionally end-capped by

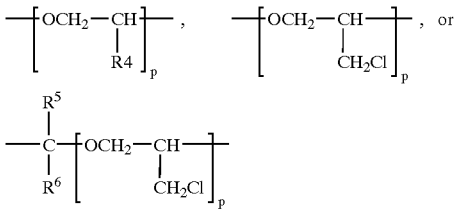

in which n is 0 to 12, p is 1 to 50, and $R^4$, $R^5$ and $R^6$ are the same or different H or alkyl containing 1 to 6 carbon atoms; and X is —O—, —S—, or —N($R^7$)—in which $R^7$ is H, alkyl containing 1 to 6 carbon atoms or a $R^f$—$R_k$—$R^2$— group.

More particularly, $R^f$ is a fully-fluorinated straight or branched aliphatic radical of 3 to 20 carbon atoms that can be interrupted by oxygen atoms.

In a preferred embodiment, the fluorochemical compound that contains a single functional group can be represented by the formula:

$$R^f—(CH_2)q—X—H$$

wherein

| | |
|---|---|
| X | is —O—, —S—, or —N($R^7$)— in which $R^7$ is H, alkyl containing 1 to 6 carbon atoms or a $R^f$—$R_k$—$R^2$— group. |
| $R^f$ | is a mixture of perfluoroalkyl groups, $CF_3CF_2(CF_2)_r$ in which r is 2 to 18; and |
| q | is 1, 2 or 3. |

In a more particular embodiment, $R^f$ is a mixture of said perfluoroalkyl groups, $CF_3CF_2(CF_2)r$; and r is 2, 4, 6, 8, 10, 12, 14, 16, and 18. In a preferred embodiment, r is predominantly 4, 6 and 8. In another preferred embodiment, r is predominantly 6 and 8. The former preferred embodiment is more readily available commercially and is therefore less expensive, while the latter may provide improved properties.

Representative fluoroaliphatic alcohols that can be used as the fluorochemical compound that contains a single functional group for the purposes of this invention are:

$$C_sF_{(2S+1)}(CH_2)_tOH$$

$$(CF_3)_2CFO(CF_2CF_2)_uCH_2CH_2OH$$

$$C_sF_{(2S+1)}CON(R^8)\ (CH_2)_tOH$$

$$C_sF_{(2S+1)}SO_2N(R^8)(CH_2)_tOH$$

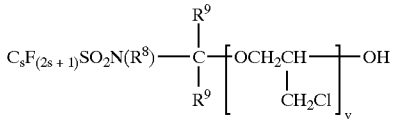

wherein s is 3 to 14;

t is 1 to 12;

u is 1 to 5;

v is 1 to 5:

each of $R^8$ and $R^9$ is H or alkyl containing 1 to 6 carbon atoms

In another embodiment, the fluorochemical compound that contains a single functional group can be represented by the formula: $H(CF_2CF_2)_wCH_2OH$ wherein w is 1–10. The latter fluorochemical compound is a known fluorochemical compound that can be prepared by reacting tetrafluoroethylene with methanol. Yet another such compound is 1,1,1,2,2,2-hexafluoro-isopropanol having the formula: $CF_3(CF_3)CHOH$.

In yet another embodiment of the invention, a non-fluorinated organic compound which contains a single functional group can be used in conjunction with one or more of said fluorochemical compounds. Usually between about 1% and about 60% of the isocyanate groups of the polyisocyanate are reacted with at least one such non-fluorinated compound. For example, said non-fluorinated compound can be represented by the formula:

$$R^{10}—R^{11}{}_k—YH$$

wherein $R^{10}$ is a $C_1$–$C_{18}$ alkyl, a $C_1$–$C_{18}$ omega-alkenyl radical or a $C_1$–$C_{18}$ omega-alkenoyl;

$R^{11}$ is

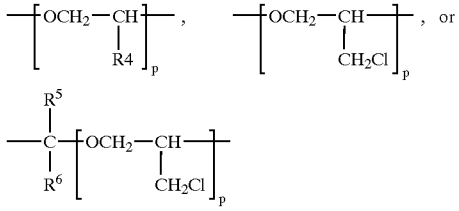

in which $R^4$, $R^5$ and $R^6$ are the same or different H or alkyl radical containing 1 to 6 carbon atoms and p is 1 to 50;

Y is —O—, —S—, or —N($R^7$)— in which $R^7$ is H or alkyl containing 1 to 6 carbon atoms; and k and p are as defined above.

For example, the non-fluorinated compound can be an alkanol or a monoalkyl or monoalkenyl ether or ester of a polyoxyalkylene glycol. Particular examples of such compounds include stearyl alcohol, the monomethyl ether of polyoxethylene glycol, the mono-allyl or -methallyl ether of polyoxethylene glycol, the mono-methacrylic or acrylic acid ester of polyoxethylene glycol, and the like.

Any polyisocyanate having three or more isocyanate groups can be used for the purposes of this invention. For example, one can use hexamethylene diisocyanate homopolymers having the formula:

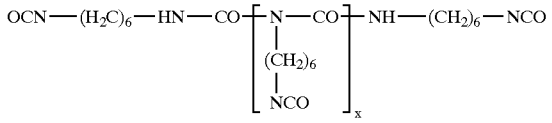

wherein x is an integer equal to or greater than 1, preferably between 1 and 8. Because of their commercial availability, mixtures of such hexamethylene diisocyanate homopolymers are preferred for purposes of this invention. Also of interest are hydrocarbon diisocyanate-derived isocyanurate trimers, which can be represented by the formula:

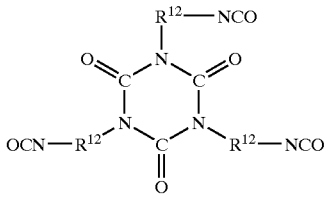

wherein $R^{12}$ is a divalent hydrocarbon group, preferably aliphatic, alicyclic, aromatic or arylaliphatic. For example, $R^{12}$ can be hexamethylene, toluene or cyclohexylene, preferably the former. Other polyisocyanates useful for the purposes of this invention are those obtained by reacting three moles of toluene diisocyanate with 1,1,1-tris-(hydroxymethyl)-ethane or 1,1,1-tris(hydroxymethyl)-propane. The isocyanurate trimer of toluene diisocyanate and that of 3-isocyanatomethyl-3,4,4-trimethylcyclohhexyl isocyanate are other examples of polyisocyanates useful for the purposes of this invention, as is methin-tris-(phenylisocyanate). Also useful for the purposes of this invention is the polyisocyanate having the formula:

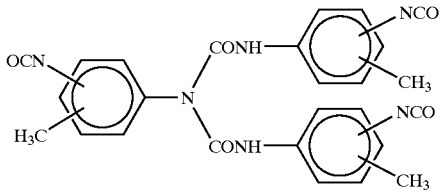

The polyfluoro organic compounds used in the invention are prepared by reacting: (1) at least one polyisocyanate or mixture of polyisocyanates which contains at least three isocyanate groups per molecule with (2) at least one fluorochemical compound which contains per molecule (a) a single functional group having one or more Zerewitinoff hydrogen atoms and (b) at least two carbon atoms each of which contains at least two fluorine atoms. Thereafter the remaining isocyanate groups are reacted with water to form one or more urea linkages. Usually between about 40% and about 95% of the isocyanate groups will have been reacted before water is reacted with the polyisocyanate. In other words, the amount of water generally is sufficient to react with from about is 5% to about 60 of the isocyanate groups in the polyisocyanate. Preferably, between about 60% and 90% of the isocyanate groups have been reacted before water is reacted with the polyisocyanate, and most preferably between about 70% and 85% of the isocyanate groups have been reacted prior to reaction of water with the polyisocyanate. Thus, in a preferred embodiment the amount of water is sufficient to react with about 10% to about 35% of the isocyanate groups, most preferably between 15% and 30%.

In one embodiment, water-modified fluorochemical carbamates have been prepared by the sequential catalyzed reaction of Desmodur N-100, Desmodur N-3200 or Desmodur N-3300, or mixtures thereof, with a stoichiometric deficiency of a perfluoroalkyl compound containing one functional group, and then with water. Desmodur N-100 and Desmodur N-3200 are hexamethylene diisocyanate homopolymers commercially available from Mobay Corporation. Both presumably are prepared by the process described in U.S. Pat. No. 3,124,605 and presumably to give mixtures of the mono-, bis-, tris-, tetra- and higher order derivatives which can be represented by the general formula:

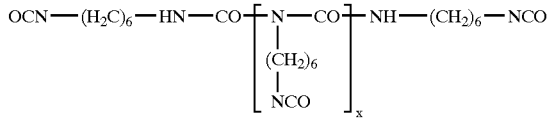

wherein x is an integer equal to or greater than 1, preferably between 1 and 8.

| Typical Properties | Avg. Equiv. Wt. | NCO Content. % |
|---|---|---|
| Desmodur N-100 | 191 | 22.0 |
| Desmodur N-3200 | 181 | 23.2 |

The typical NCO content of Desmodur N-100 approximates that listed for a SRI International Report (Isocyanates No. ID, July, 1983, Page 279) hexamethylene diisocyanate homopolymer with the following composition:

| Product Composition | Wt. % |
|---|---|
| Hexamethylene diisocyanate | 0.1 |
| Monobiuret | 44.5 |
| Bisbiuret | 17.4 |
| Trisbiuret | 9.5 |
| Tetrabiuret | 5.4 |
| Higher Mol. Wt. Derivatives | 23.1 |
| NCO Content | 21.8 |

Based on its average equivalent weight and NCO content, the comparative bis-, tris-, tetra-, and the like, content of Desmodur N-3200 should be less than that of the N-100 product. Desmodur N-3300 is a hexamethlylene diisocyanate-derived isocyanurate trimer that can be represented by the formula:

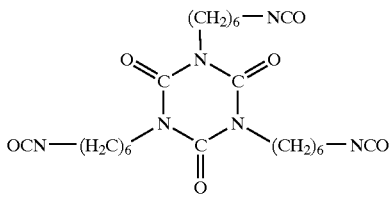

The water-modified fluorochemical carbamates are typically prepared by first charging the polyisocyanate, the perfluoroalkyl compound and a dry organic solvent such as methyl isobutyl ketone (MIBK) to a reaction vessel. The order of reagent addition is not critical. The specific weight of, aliphatic polyisocyanate and perfluoroalkyl compounds charged is based on their equivalent weights and on the working capacity of the reaction vessel and is adjusted so that all Zerewitinoff active hydrogens charged will react with some desired value between 40% and 95% of the total NCO group charge. The weight of dry solvent is typically 15%–30% of the total charge weight. The charge is agitated under nitrogen and heated to 40°–70° C. A catalyst, typically dibutyltindilaurate per se, or as a solution in MIBK, is added in an amount which depends on the charge, but is usually small, e.g., 1 to 2 parts per 10,000 parts of the polyisocyanate. After the resultant exotherm, the mixture is agitated at a temperature between 65° and 105° C. for 2–20 hours from the time of the catalyst addition, and then, after its temperature is adjusted to between 55° and 90° C., isitreated with water per se or with wet MIBK for an additional 1 to 20 hours.

The use of a stoichiometric excess of a polyisocyanate assures complete reaction of the fluorinated and non-fluorinated organic compounds that, coupled with subsequent reaction with water, provides fluorochemical compounds that are preferred for use in the soil resist agents of the present invention.

In another embodiment the fluorochemical compounds suitable for use in the. present invention include perfluoroalkyl esters and mixtures thereof with vinyl polymers described by Dettre et al. in U.S. Pat. No. 3,923,715, incorporated herein by reference. The fluorochemical compounds disclosed by Deitre comprise an aqueous dispersion of a composition of more than 0 and up to 95% of a non-fluorinated vinyl polymer having an adjusted Vickers Hardness of about 10 to about 20, and 5 to less than 100% of a perfluoroalkyl ester of a carboxylic acid of from 3 to 30 carbon atoms. U.S. Pat. No. 3,923,715 disclosed that volatility is important in minimizing flammability.

Many of the known esters of fluorinated alcohols and organic acids are useful as the perfluoroalkyl ester compound useful in the invention. Representative of the fluorinated alcohols that can be used to make the ester are $(CF_3)_2CFO(CF_2CF_2)_pCH_2CH_2OH$ where p is 1 to 5; $(CF_3)_2CF(CF_2CF_2)_qCH_2CH_2OH$ where q is 1 to 5; $R^fSO_2N(R')CH_2OH$ where $R^f$ is perfluoroalkyl of 4 to 12 carbons and R' is H or lower alkyl; $C_nF_{(2n+1)}(CH_2)_m$—OH or —SH where n is 3 to 14 and m is 1 to 12; $R^fCH_2C(X)H(CH_2)_rOH$ where r is >1 X is —$O_2C$—alkyl, —$(CH_2)_sOH$, —$(CH_2)_sO_2C$ alkyl or —OH wherein s is an integer of 0 to 10 and $R^f$ is perfluoroalkyl of 3 to 21 carbons; $R^fCON(R)$—$(CH_2)_tOH$ where $R^f$ is perfluoroalkyl of 4 to 18 carbons, t is 2 to 6 and R is an alkyl group of 4 to 10 carbons.

The preferred fluorinated esters utilize perfluoroalkyl aliphatic alcohols of the formula $C_nF_{(2n+1)}(CH_2)_mOH$ where n is from about 3 to 14 and m is 1 to 3. Most preferred are esters formed from a mixture of the alcohols where n is predominantly 10, 8 and 6 and m is 2. These esters are formed by reacting the alcohol or mixture of alcohols with mono- or polycarboxylic acids which can contain other substituents and which contain from 3 to 30 carbons. In one method of preparing the esters, the alcohol is heated with the acid in the presence of catalytic amounts of p-toluenesulfonic acid and sulfuric acid, and with benzene, the water of reaction being removed as a codistillate with the benzene. The residual benzene is removed by distillation to isolate the ester.

The 2-perfluoroalkyl ethanols of the formula $C_nF_{(2n+1)}CH_2CH_2OH$ wherein n is from 6 to 14, and preferably a mixture of 2-perfluoroalkylethanols whose values of n are as described above, are prepared by the known hydrolysis with oleum of 2-perfluoroalkylethyl iodides, $C_nF_{(2n+1)}CH_2CH_2$ I. The 2-perfluoroalkylethyl iodides are prepared by the known reaction of perfluoroalkyl iodide with ethylene. The perfluoroalkyl iodides are prepared by the known telomerization reaction using tetrafluoroethylene and thus each perfluoroalkyl iodide differs by —$(CF_2$—$CF_2)$— unit.

To produce the perfluoroalkyl ester compounds useful as the fluorochemical component in the present invention wherein the number of carbon atoms in the perfluoroalkyl portion of the molecule is in the range of 6 to 14, removal of perfluoroalkyl iodides boiling below about 116°–119° C. (atmospheric boiling point of $C_6F_{13}$ I) and above about 93°–97° C. at 5 mm pressure (666 Pa), (5 mm pressure boiling range of $C_{14}F_{29}$I) is carried out. This yields a mixture of perfluoroalkyl iodides wherein the number of carbon atoms in the perfluoroalkyl portion of the molecule is in the range of 6 to 14 carbon atoms. Another method for preparing esters employed as the fluorochemical component in the instant invention is to react perfluoroalkylethyl bromides or iodides with an alkali metal carboxylate in an anhydrous alcohol.

A preferred fluoroester for use as the fluorochemical component of the invention is the citric acid urethane. Therein, the citric acid ester is modified by reacting the ester with an isocyanate compound, for example, hexamethylene diisocyanate, which reacts with the —OH group of the citric acid ester to form urethane linkages.

Perfluoroalkyl esters combined with vinyl polymers are also suitable for use herein. By vinyl polymer is meant a polymer derived by polymerization or copolymerization of vinyl monomers (vinyl compounds) including vinyl chloride and acetate, vinylidene chloride, methyl acrylate and methacrylate, acrylonitrile, styrene and vinyl esters and numerous others characterized by the presence of a carbon double bond in the monomer molecule which opens during polymerization to make possible the carbon chain of the polymer. The vinyl polymer has an adjusted Vickers Hardness of about 10 to about 20. The preferred vinyl polymer is poly(methylmethacrylate) having an adjusted Vickers Hardness of 16.1.

The adjusted Vickers Hardness relates to the effectiveness of soil resistance. A Vickers diamond indenter is used in an Eberbach Micro Hardness Tester (Eberbach Corp., Ann Arbor, Mich.). The procedure follows that described in American Society of Testing Materials Standard D 1474-68 for Knoop Hardness, with the following adjustments. A Vickers indenter is used instead of a Knoop indenter, a 50 g load is used instead of a 25 g load, the load is applied for 30 s instead of for 18 s, the measurement is made at 25±10% relative humidity instead of 50±5% relative humidity, and the hardness value is calculated using the Vickers formula instead of the Knoop formula.

The Vickers Hardness method is described in the American Society of Testing Materials Standard E 92-67. Description of the Vickers indenter and the calculation of Vickers Hardness is found therein.

The term "adjusted Vickers Hardness" refers to the hardness value obtained by using the Vickers formula but not the Vickers method. The vinyl polymers which function satisfactorily as component of the soil resist agent of the invention must possess an adjusted Vickers Hardness of about 10 to 20. Adjusted hardness can be determined on a polymer sample deposited on a glass plate in solvent solution, the solvent being evaporated and a smooth coating obtained by heating at about 150° to 175° C. for 3 to 5 minutes.

Alternatively, a smooth coating can be obtained by pressing between glass plates at 100° to 150° C. after the solvent has evaporated. Any suitable solvent can be employed to dissolve the polymers, ethers, ketones and other good solvent types being particularly useful. The coating should be sufficiently thick (75 to 250 micrometers) so that the indenter used in the test does not penetrate more than 15% of the coating thickness.

Poly(methylmethacrylate) latices can be prepared by known aqueous emulsion polymerization to provide dispersions containing very fine particles of high molecular weight and narrow molecular weight distribution using an oxygen-free system and an initiator such as potassium persulfate/sodium bisulfite in combination.

The aqueous dispersion of fluorinated ester can be blended with an aqueous latex of poly(methylmethacrylate) to make a composition which is extendible in water, and can be diluted therewith for application to substrates. The dispersion before dilution will normally contain from about 5% to 15% of the fluorinated ester and 3 to 30% of the methyl methacrylate polymer.

The fluorochemical component of the present invention can be stored and/or used as prepared or after further solvent dilution, or converted by standard technology to an aqueous dispersion using a dispersant to stabilize the dispersion. The fluorochemical component of the present invention is converted by standard technology to a dispersion in water or in a mixture of water and solvent. While it is usually desirable to minimize organic solvents in soil resist agents, residual or added solvents such as low molecular weight alcohols (e.g., ethanol) or ketones (e.g., acetone or MIBK) can be used. Preferred for use in the practice of the present invention is an aqueous dispersion optionally containing solvents and dispersion stabilizers such as glycols. This fluorochemical dispersion is combined with the anionic non-fluorinated surfactant to yield the soil resist agent of the present invention. The additional anionic non-fluorinated surfactant in the desired amount is added to the fluorochemical dispersion with stirring. This addition can be made to the fluorochemical dispersion in the concentrated form as shipped or at the point of application when diluted for use.

In the practice of the present invention, the preferred soil resist agents comprise a polyfluoro organic compound having at least one of a urea, urethane, or ester linkage that is the product of the reaction of: (1) at least one organic polyisocyanate containing at least three isocyanate groups, (2) at least one fluorochemical compound which contains per molecule (a) a single functional group having one or more Zerewitinoff hydrogen atoms and (b) at least two carbon atoms each of which contains at least two fluorine atoms, and (3) water in an amount sufficient to react with from about 5% to about 60% of the isocyanate groups in said polyisocyanate, combined with at least one anionic non-fluorinated surfactant selected from the group consisting of sodium dodecyl diphenyloxide disulfonate, alkyl aryl sulfate, sodium alkyl sulfate, $C_{16}$–$C_{18}$ potassium phosphate, sodium decyl diphenyloxide disulfonate, and a blend of sodium decyl diphenyloxide disulfonate with condensed naphthalene formaldehyde sodium sulfonate.

The present invention further comprises a method of treating fibrous substrates for soil resistance comprising application to the fibrous substrates of a soil resist agent comprising a dispersion in water or water and solvent of a) a polyfluoro organic compound having at least one of a urea, urethane, or ester linkage, and b) at least one anionic non-fluorinated surfactant, wherein the ratio of polyfluoro organic compound to surfactarit is from about 0.075:1.0 to about 5:1.

Suitable substrates for the application of the products of this invention are films, fibers, yarns, fabrics, carpeting, and other articles made from filaments, fibers, or yarns derived from natural, modified natural, or synthetic polymeric materials or from blends of these other fibrous materials. Specific representative examples are cotton, wool, silk, nylon including nylon 6, nylon 6,6 and aromatic polyamides, polyesters including poly(ethyleneterephthalate) and poly (trimethyleneterephthalate) (abbreviated PET and PTT, respectively), poly(acrylonitrile), polyolefins, jute, sisal, and other cellulosics. The soil resist agents of this invention impart soil resistance and/or oil-, water-, and soil-repellency properties to fibrous substrates. The type of substrate of particular interest in accordance with the present invention is carpeting, particularly nylon carpeting, to which soil resist agents of the present invention are applied.

The soil resist agents of the present invention are applied to suitable substrates by a variety of customary procedures. For the fibrous substrate end-use, one can apply them from an aqueous dispersion or an organic solvent solution by brushing, dipping, spraying, padding, roll coating, foaming or the like. They can also be applied by use of the conventional beck dyeing procedure, continuous dyeing procedure or thread-line application. The soil resist agents of this invention are applied to the substrate as such or in combination with other textile finishes, processing aids, foaming agents, lubricants, anti-stains, and the like. This new agent provides improved early soiling performance versus current carpet fluorochemical soil resist agents. The product is applied at a carpet mill, by a,carpet retailer or installer prior to installation, or on a newly installed carpet.

The present invention further comprises a fibrous substrate treated with a soil resist agent comprising a dispersion in water or water and solvent of (a) a polyfluoro organic compound having at least one of a urea, urethane, or ester linkage, and (b) at least one anionic non-fluorinated surfactant, wherein the ratio of polyfluoro organic compound to surfactant is from about 0.075:1 to about 5:1.

The fibrous substrates of the present invention include those substrates previously described. Of particular interest is carpet, especially nylon carpet. The soil resist agent used to treat the substrate of the present invention is as previously described herein. A variety of methods for application of the soil resist agent are used as described above. The treated substrate of the present invention has superior resistance to soiling and/or oil-, water-, and soil repellency properties.

Contrary to the practice and teaching of the prior art, the soil resist agents of the present invention are useful to provide enhanced soil resist properties when applied to fibrous substrates.

TEST METHODS

Test Method 1

Accelerated Soiling Test

A drum mill (on rollers) was used to tumble synthetic soil onto the carpet. Synthetic soil was prepared as described in AATCC Test Method 123-2000, Section 8.

Preparation of Soil-coated Beads:

Synthetic soil, 3 g, and 1 liter of clean nylon resin beads (SURLYN ionomer resin beads ⅛–3⁄16 inch (0.32–0.48 cm) diameter were placed into a clean, empty canister. SURLYN is an ethylene/methacrylic acid copolymer, available from E. I. du Pont de Nemours and Co., Wilmington Del.). The canister lid was closed and sealed with duct tape and the canister rotated on rollers for 5 minutes. The soil-coated beads were removed from the canister.

Preparation of Carpet Samples to Insert into the Drum:

Total sample size was 8×25 inch (20.3×63.5 cm) for these tests. One test item and one control item were tested at the same time. The carpet pile of all samples was laid in the same direction. The shorter side of each carpet sample was cut in the machine direction (with the tuft rows).

Method:

Strong adhesive tape was placed on the backside of the carpet pieces to hold them together. The carpet samples were placed in the clean, empty drum mill with the tufts facing toward the center of the drum. The carpet was held in place in the drum mill with rigid wires. Soil-coated resin beads, 250 cc, and 250 cc of ball bearings (5/16 inch, 0.79 cm diameter) were placed into the drum mill. The drum mill lid was closed and sealed with duct tape. The drum was run on the rollers for 2½ minutes at 105 rpm. The rollers were stopped and the direction of the drum mill reversed. The drum was run on the rollers for an additional 2½ minutes at 105 rpm. The carpet samples were removed and vacuumed uniformly to remove excess dirt. The soil-coated beads were discarded.

Evaluation of Samples:

The Delta E color difference for the soiled carpet was measured for the test and control items versus the original unsoiled carpet.

Test Method 2

Color Measurement of Soiling Performance

Color measurement of each carpet was conducted on the carpet following the accelerated soiling test. For each control and test sample the color of the carpet was measured, the sample was soiled, and the color of the soiled carpet was measured. The Delta E is the difference between the color of the soiled and unsoiled samples, expressed as a positive number. The color difference was measured on each item, using a Minolta Chroma Meter CR-310. Color readings were taken at five different areas on the carpet sample, and the average Delta E was recorded. The control carpet for each test item was of the same color and construction as the test item. The control carpet had been treated with the fluorochemical dispersion with no additional surfactant.

Delta Delta E was calculated by subtracting the Delta E of the control carpet from the Delta E of the test item. A larger negative value for Delta Delta E indicated that the test carpet had better performance and had less soiling than the control. A larger positive value for Delta Delta E indicated that the test carpet had poorer performance and had soiled more than the control.

Test Method 3

Floor Traffic Soiling Test Method

Carpets were installed in a busy corridor of a school or office building and subjected to human foot traffic in a controlled test area. The corridor was isolated from exits and had substantial walk-off mats and carpeted areas prior to the soiling test area. The unit "foot traffic" was the passing of one individual in either direction and was recorded with automated traffic counters. A Delta Delta E measurement was made as in Test Method 2.

EXAMPLES

Examples 1–13

These examples investigated the enhancement of soil resist performance of carpet by addition of significant quantities of anionic non-fluorinated surfactant, as listed in Table 2, to a dispersed fluorochemical soil resist. The surfactants were commercially available, as listed in Table 3. The carpet used in this example consisted of a level loop commercial carpet (26 oz./yd$^2$, 0,88 kg/m$^2$), having a nylon 6,6 face fiber that had been dyed to a yellow color. The control carpet for this example was treated with a dispersed fluorochemical soil resist, available from E. I. du Pont de Nemours and Company, Wilmington Del., and which contained the fluorochemical disclosed in U.S. Pat. No. 5,411,766 at a level of 22.6% with surfactant at a level of 1.4%, and with a ratio of fluorochemical:dispersant of 16:1. This dispersed fluorochemical soil resist was spray applied at 25% wet pick-up (wpu) and dried to a carpet face temperature of 250° F. (121° C.). The "wet pick-up" in textile processing is the amount of liquid, and material carried by the liquid, applied to a textile, and is usually expressed as a percentage of either the dry or conditioned weight of the textile prior to processing (AATCC Technical Manual, Vol. 77, p. 414, op. cit.). The test compositions were made up of the same dispersed fluorochemical soil resist plus the anionic non-fluorinated surfactant as listed in Table 2. Each test composition was applied to the carpet with a spray application at 25% wpu and dried to the same carpet face temperature. The application levels for control and test compositions are given in Table 6A. Carpets were tested by the accelerated soiling Test Method 1 versus control carpet that had been treated with the same fluorochemical soil resist. The test carpets were evaluated according to Test Methods 1 and 2, to provide the Color Measurement of Soiling Performance shown in Table 6A.

Comparative Examples A–H

The procedure of Example 1 was repeated substituting cationic and nonionic surfactants, as listed in Table 4, for the anionic surfactant. The test compositions were made up of the fluorochemical soil resist described in Examples 1–13 plus the surfactant as listed in Table 4. The cationic and nonionic surfactants were commercially available as listed in Table 5. The carpets were evaluated according to Test methods 1 and 2 and the results are shown in Table 6B.

Comparative Example I

The procedure of Examples 1–13 was repeated using Dowfax 2A4 at a flurorchemical:surfactant ratio of 0.05:1.0. At this ratio, the improved: soil resist performance was not present, as shown in Table 6B.

TABLE 2

Non-fluorinated Surfactants Used in Examples 1–13.

| Ex. # | Surfactant Trade Name (listed alphabetically) | Ionic Nature | Composition | % Solids |
|---|---|---|---|---|
| 1 | Alphastep MC-48 | Anionic | Alpha sulfonated carboxylic acids & esters, Na salts | 40 |
| 2 | Bioterge PAS 8S | Anionic | 1-octane sulfonate, sodium salt | 40 |

TABLE 2-continued

Non-fluorinated Surfactants Used in Examples 1–13.

| Ex. # | Surfactant Trade Name (listed alphabetically) | Ionic Nature | Composition | % Solids |
|---|---|---|---|---|
| 3 | Blend of Dowfax 3B2 + Petrodispersant 425 | Anionic | 45% 3B2 + 45% 425 PD liquid + 10% water | 43 |
| 4 | Cenegen 7 | Anionic | Alkyl aryl sulfate | 47 |
| 5 | Dowfax 2A4 | Anionic | Sodium dodecyl diphenyloxide disulfonate | 45 |
| 6 | Dowfax 3B2 | Anionic | Sodium decyl diphenyloxide disulfonate | 47 |
| 7 | | Anionic hydrotrope | Dimethyl-5-sulfoisophthalate, Na salt | 100 |
| 8 | Nopcosprse 9268A | Anionic | Sodium butyl naphthalene sulfonate | 76 |
| 9 | P-347 | Anionic | C16–C18 potassium phosphate | 40 |
| 10 | Petrodispersant 425 liquid | Anionic | Condensed naphthalene formaldehyde sodium sulfonate | 46 |
| 11 | Sulfonate AA-10 | Anionic | Sodium dodecyl benzene sulfonate (branched) | 97 |
| 12 | Supralate WAQE | Anionic | Sodium alkyl sulfate | 30 |
| 13 | Witco C-6094 | Anionic | Alpha olefin sulfonate | 40 |

TABLE 3

Non-fluorinated Anionic Surfactant Sources

| Ex. # | Surfactant Trade Name | Type | Supplier and Location |
|---|---|---|---|
| 1 | Alphastep MC-48 | Anionic | Stepan, Northfield IL |
| 2 | Bioterge PAS 8S | Anionic | Witco, Houston TX |
| 4 | Cenegen 7 | Anionic | Yorkshire America, Charlotte NC |
| 5 | Dowfax 2A4 | Anionic | Dow Chemical Co., Midland MI |
| 6 | Dowfax 3B2 | Anionic | Dow Chemical Co., Midland MI |
| 7 | | Anionic hydrotrope | E. I. du Pont de Nemours and Co., Wilmington DE |
| 8 | Nopcosprse 9268A | Anionic | Henkel/Cognis, Cincinnati OH |
| 9 | P-347 | Anionic | Matsumoo Yushi-Seiyaka, Osaka, Japan |
| 10 | Petrodispersant 425 liquid | Anionic | Performance Chemicals Group, Houston TX |
| 11 | Sul-Fon-Ate AA-10 | Anionic | Tennessee Chemical Co., Atlanta GA |
| 12 | Supralate WAQE | Anionic | Witco, Houston TX |
| 13 | Witco C-6094 | Anionic | Witco, Houston TX |

TABLE 4

Surfactants Used in the Comparative Examples A–I

| Comp. Ex. # | Surfactant Trade Name | Ionic Nature | Composition | % Solids |
|---|---|---|---|---|
| A | Arquad 16-29 | Cationic | Trimethyl, hexadecyl-ammonium chloride | 29 |
| B | Arquad 18-50 | Cationic | Trimethyl, octadecyl-ammonium chloride | 50 |
| C | Arquad 2C-75 | Cationic | Dimethyl, dicocoammonium chloride | 75 |
| D | Avitex 2153 | Cationic | mixture of amine and its HCl salt | 30 |
| E | Avitex E | Cationic | methyl sulfate quaternary salt | 42 |
| F | Brij 78 | Non-ionic | C18 alcohol + 20 EO | 100 |

TABLE 4-continued

Surfactants Used in the Comparative Examples A–I

| Comp. Ex. # | Surfactant Trade Name | Ionic Nature | Composition | % Solids |
|---|---|---|---|---|
| G | Ethoquad C/25 | Cationic | Ethoxylated N-methyl, cocoamine | 100 |
| H | Tergitol NP-9 | Non-ionic | Nonylphenol + 9EO | 100 |
| I | Dowfax 2A4 | Anionic | Sodium dodecyl diphenyloxide disulfonate | 45 |

TABLE 5

Surfactant Sources for Comparative Examples A–I

| Comp. Ex. # | Surfactant Trade Name | Type | Supplier and Location |
|---|---|---|---|
| A | Arquad 16-29 | Cationic | Akzo Chemicals, Inc., Chicago IL |
| B | Arquad 18-50 | Cationic | Akzo Chemicals, Inc., Chicago IL |
| C | Arquad 2C-75 | Cationic | Akzo Chemicals, Inc., Chicago IL |
| D | Avitex 2153 | Cationic | E. I. du Pont de Nemours & Co., Wilmington DE |
| E | Avitex E | Cationic | E. I. du Pont de Nemours & Co., Wilmington DE |
| F | Brij 78 | Nonionic | Uniqema, New Castle DE |
| G | Ethoquad C/25 | Cationic | Akzo Chemicals, Inc., Chicago IL |
| H | Tergitol NP-9 | Nonionic | Union Carbide, Danbury CT |
| I | Dowfax 2A4 | Anionic | Dow Chemical Co., Midland MI |

TABLE 6A

Results for Examples 1–13.

| Ex. # | Fluoro-chemical, % owf*, 100% Solids Basis. | Surfactant Trade Name | Ionic Nature | % owf* Surfac-tant, 100% Solids Basis | Nylon Carpet Drum Soil Test** versus F-Chem only. Delta Delta E | FC: Sur-factant Ratio |
|---|---|---|---|---|---|---|
| Anionic Non-Fluorinated Surfactants of Examples 1–13 | | | | | | |
| 1 | 0.2% | Alphastep MC-48 | Anionic | 0.2 | −1.7 | 1.0:1.0 |
| 2 | 0.2% | Bioterge PAS-85 | Anionic | 0.2 | −1.3 | 1.0:1.0 |
| 3 | 0.2% | Dowfax 3B2 + Petrodispersant 425 Blend*** | Anionic | 0.2 | −3.4 | 1.0:1.0 |
| 4a | 0.2% | Cenegen 7 | Anionic | 0.2 | −4.7 | 1.0:1.0 |
| 4b | 0.2% | Cenegen 7 | Anionic | 0.35 | −4.7 | 0.6:1.0 |
| 4c | 0.2% | Cenegen 7 | Anionic | 0.44 | −4.1 | 0.4:1.0 |
| 5a | 0.2% | Dowfax 2A4 | Anionic | 2.0 | −1.8 | 0.1:1.0 |
| 5b | 0.2% | Dowfax 2A4 | Anionic | 0.6 | −2.4 | 0.3:1.0 |
| 5c | 0.2% | Dowfax 2A4 | Anionic | 0.3 | −4.7 | 0.7:1.0 |
| 5d | 0.2% | Dowfax 2A4 | Anionic | 0.11 | −2.4 | 1.8:1.0 |
| 5e | 0.2% | Dowfax 2A4 | Anionic | 0.06 | −1.1 | 3.3:1.0 |
| 6 | 0.2% | Dowfax 3B2 | Anionic | 0.2 | −3.4 | 1.0:1.0 |
| 7 | 0.2% | | Anionic | 0.2 | −1.9 | 1.0:1.0 |
| 8 | 0.2% | Nopcosprse 9268A | Anionic | 0.2 | −2.6 | 1.0:1.0 |
| 9 | 0.2% | P-347 | Anionic | 0.2 | −4.2 | 1.0:1.0 |
| 10 | 0.2% | Petrodispersant 425 liquid | Anionic | 0.2 | −2.0 | 1.0:1.0 |
| 11 | 0.2% | Sulfonate AA-10 | Anionic | 0.2 | −1.4 | 1.0:1.0 |

TABLE 6A-continued

Results for Examples 1–13.

| Ex. # | Fluoro-chemical, % owf*, 100% Solids Basis. | Surfactant Trade Name | Ionic Nature | % owf* Surfac-tant, 100% Solids Basis | Nylon Carpet Drum Soil Test** versus F-Chem only. Delta Delta E | FC: Sur-factant Ratio |
|---|---|---|---|---|---|---|
| Anionic Non-Fluorinated Surfactants of Examples 1–13 | | | | | | |
| 12 | 0.2% | Supralate WAQE | Anionic | 0.2 | −4.4 | 1.0:1.0 |
| 13 | 0.2% | Witco C-6094 | Anionic | 0.2 | −1.0 | 1.0:1.0 |

FC: surfactant ratio is the ratio of the fluorochemical to the sum of the dispersant and surfactant
Examples 4 and 5 were replicated with differing amounts of added surfactant
*owf: based on the weight of the fiber.
**Test methods 1 and 2.
***Blend composition, see Table 2.

TABLE 6B

Results for Comparative Examples A–I.

| Ex. # | Fluoro-chemical, % owf*, 100% Solids Basis. | Surfactant Trade Name | Ionic Nature | % owf* Sur-factant, 100% Solids Basis | Nylon Carpet Drum Soil Test** versus F-Chem only. Delta Delta E | FC: Sur-factant Ratio |
|---|---|---|---|---|---|---|
| A | 0.2% | Arquad 16-29 | Cationic | 0.2 | 18.7 | 1.0:1.0 |
| B | 0.2% | Arquad 18-50 | Cationic | 0.2 | 9.6 | 1.0:1.0 |
| C | 0.2% | Arquad 2C-75 | Cationic | 0.2 | 12.9 | 1.0:1.0 |
| D | 0.2% | Avitex 2153 | Cationic | 0.2 | 16.6 | 1.0:1.0 |
| E | 0.2% | Avitex E | Cationic | 0.2 | 10.7 | 1.0:1.0 |
| F | 0.2% | Brij 78 | Nonionic | 0.2 | 1.8 | 1.0:1.0 |
| G | 0.2% | Ethoquad C/25 | Cationic | 0.2 | 11.8 | 1.0:1.0 |
| H | 0.2% | Tergitol NP-9 | Nonionic | 0.2 | 14.2 | 1.0:1.0 |
| I | 0.2% | Dowfax 2A4 | Anionic | 4.0 | 4.0 | 0.05:1.0 |

FC: surfactant ratio is the ratio of the fluorochemical to the sum of the dispersant and surfactant
*owf: based on the weight of the fiber.
**Test methods 1 and 2.

The data in Tables 6A and 6B showed the lower soiling with Examples 1–13 having the anionic non-fluorinated surfactants present, compared with carpet treated with the same fluorochemical without the added anionic non-fluorinated surfactant. The Comparative Examples A–H showed higher soiling when a cationic or nonionic non-fluorinated surfactant was added to the fluorochemical soil resist prior to application. Comparative Example I showed the improved soil resist improvement was not present at the FC:surfactant ratio of 0.05:1.0

Example 14

This example investigated the enhancement of soil resist performance of carpet constructed with unscoured solution pigmented nylon 6,6 fiber by addition, of a significant quantity of anionic non-fluorinated surfactant to a dispersed fluorochemical soil resist. The carpet used in this example consisted of a level loop commercial carpet (26 oz/yd$^2$, 0.88 kg/m$^2$), constructed with unscoured solution pigmented nylon 6,6 face fiber, which was a tan color. The control carpet for this example was treated with the same dispersed fluorochemical soil resist as used in Examples 1–13, which was spray applied at 25% wpu and dried to a carpet face temperature of 250° F. (121° C.). The test composition was made of the same dispersed fluorochemical soil resist as used in Examples 1–13 plus the anionic non-fluorinated surfactant CENEGEN 7, available from Yorkshire America, Charlotte N.C. The test composition was applied to the carpet with a spray application at 25% wpu and dried to a carpet face temperature of 250° F. (121° C.). The application levels for control and test compositions are shown in Table 7. Carpets were tested by the accelerated soiling method versus control carpet which had been treated with the same dispersed fluorochemical soil resist. The test carpets were evaluated according to Test Methods 1 and 2, to provide the Color Measurement of Soiling Performance shown in Table 7.

TABLE 7

Results for Example 14.

| Fluoro-chemical, % owf*, 100% Solids Basis. | Surfactant Trade Name | Ionic Nature | % owf* Sur-factant, 100% Solids Basis | Nylon Carpet Drum Soil Test** versus F-Chem only. Delta Delta E | FC: Surfactant Ratio |
|---|---|---|---|---|---|
| 0.2% | Cenegen 7 | Anionic | 0.36 | −1.6 | 0.6:1.0 |

FC: surfactant ratio is the ratio of the fluorochemical to the sum of the dispersant and surfactant
*owf: based on the weight of the fiber.
**Test methods 1 and 2.

The data in Table 7 showed the lower soiling with the addition of anionic non-fluorinated surfactant to fluorochemical soil resist for carpet constructed with unscoured solution pigmented nylon 6,6 fiber, compared with carpet treated with the same fluorochemical soil resist without added anionic non-fluorinated surfactant.

Example 15

This example investigated the enhancement of soil resist performance of carpet constructed with unscoured 3GT polyester fiber by addition of a significant quantity of anionic non-fluorinated surfactant to a fluorochemical soil resist. The carpet used in this example consisted of a level loop commercial carpet (28 oz/yd$^2$, 0.95 kg/m$^2$.), constructed with unscoured PTT polyester face fiber. The test composition was made of a dispersed fluorochemical soil resist, available from E. I. du Pont de Nemours and Company, Wilmington Del., which contained the fluoroalcohol citrate urethane and poly(methylmethacrylate) mixture disclosed in Example 2 of U.S. Pat. No. 3,923,715 at a level of 9.1%, except that the fluoroalcohol citrate urethane was prepared with hexamethylene diisocyanate instead of 1-methyl-2,4-diisocyanatobenzene and was anionically dispersed. This dispersed fluorochemical soil resist contained dispersant at a level of 0.3% and had a ratio of fluorochemical:dispersant of 30:1. The added anionic non-fluorinated surfactant was SUPRALATE WAQE, available from Witco Company, Houston Tex. The control carpet for this example was treated with the same fluorochemical soil resist which was spray applied at 25% wpu and dried to a carpet face temperature of 250° F. (121° C.). The application levels for control and test compositions are show in Table 8. The test composition was applied to the carpet with a spray application at 25% wpu and dried to a carpet face temperature of 250° F. (121° C.). The test carpet was tested by Test Method 3, the floor traffic soiling method, versus control carpet. The carpets were subjected to 32,000 foot traffics. Then the carpets were evaluated according to Test Method 2, the Color Measurement of Soiling Performance, and the resulting data are shown in Table 8.

TABLE 8

Results for Example 15.

| Fluoro-chemical, % owf*, 100% Solids Basis. | Surfactant Trade Name | Ionic Nature | % owf* Surfactant, 100% Solids Basis | PTT** Polyester Carpet. Traffic Soil Test***. Delta Delta E | FC: Surfactant Ratio |
|---|---|---|---|---|---|
| 0.28% | Supralate WAQE | Anionic | 0.11 | −1.4 | 2.6:1.0 |

FC: surfactant ratio is the ratio of the fluorochemical to the sum of the dispersant and surfactant
*owf: based on the weight of the fiber.
**PTT = poly(trimethyleneterephthalate) polyester fiber
***Test methods 2 and 3.

The data in Table 8 showed the lower soiling with the addition of anionic non-fluorinated surfactant to fluorochemical soil resist for carpet constructed with unscoured poly(trimethyleneterephthalate) polyester fiber, compared with carpet treated with the same fluorochemical soil resist without added anionic non-fluorinated surfactant.

Example 16

This example investigated the enhancement of soil resist performance of carpet constructed with cotton fiber by addition of a significant quantity of anionic non-fluorinated surfactant to a fluorochemical soil resist. The carpet used in this example consisted of a cut-pile residential carpet (40 oz/yd$^2$, 1.36 kgl/m$^2$.), constructed with cotton face fiber. The test composition was made of the same dispersed fluorochemical soil resist as in Example 15 plus anionic non-fluorinated surfactant SUPRALATE WAQE, available from Witco Company, Houston Tex. The control carpet for this example was treated with the same fluorochemical soil resist which was spray applied at 25% wpu and dried to a carpet face temperature of 250° F. (121° C.). The application levels for control and test compositions are show in Table 9. The test composition was appllied to the carpet with a spray application at 25% wpu and dried to a carpet face temperature of 250° F. (121° C.). The test carpet was tested by the accelerated soiling method (Test Method 1) versus control carpet which had been treated with the same dispersed fluorochemical. Then the carpets were evaluated according to Test Method 2, the Color Measurement of Soiling Performance, and the resulting data are shown in Table 9.

TABLE 9

Results for Example 16.

| Fluoro-chemical, % owf*, 100% Solids Basis. | Surfactant Trade Name | Ionic Nature | % owf* Surfactant, 100% Solids Basis | Cotton Carpet. Traffic Soil Test**. Delta Delta E | FC: Surfactant Ratio |
|---|---|---|---|---|---|
| 0.44% | Supralate WAQE | Anionic | 0.24 | −3.9 | 1.8:1.0 |

FC: surfactant ratio is the ratio of the fluorochemical to the sum of the dispersant and surfactant
*owf: based on the weight of the fiber.
**Test method 1 and 2.

The data in Table 9 showed the lower soiling with the addition of anionic non-fluorinated surfactant to fluorochemical soil resist for carpet constructed with cotton fiber, compared with carpet treated with the same fluorochemical soil resist without added anionic non-fluorinated surfactant.

What is claimed is:

1. A soil resist agent comprising a dispersion in water or water and solvent of a) a polyfluoro organic compound having at least one of a urea, urethane, or ester linkage, and b) at least one anionic non-fluorinated surfactant, wherein the ratio of polyfluoro organic compound to surfactant is from about 0.075:1.0 to about 5:1, wherein the anionic surfactant is selected from the group consisting of an alpha olefin sulfonate, salt of alpha sulfonated carboxylic acid, salt of alpha sulfonated carboxylic ester, salt of 1-octane sulfonate, alkyl aryl sulfate, salt of dodecyl diphenyloxide disulfonate, salt of decyl diphenyloxide disulfonate, salt of butyl naphthalene sulfonate, salt of $C_{16}$–$C_{18}$ phosphate, salt of condensed naphthalene formaldehyde sulfonate, salt of dodecyl benzene sulfonate, salt of alkyl sulfate, salt of dimethyl-5-sulfoisophthalate, and a blend of salt of decyl diphenyloxide disulfonate with salt of condensed naphthalene formaldehyde sodium sulfonate.

2. The soil resist agent of claim 1 wherein the ratio of polyfluoro organic compound to surfactant is from about 0.1:1.0 to about 4:1.

3. The soil resist agent of claim 1 wherein the anionic surfactant is selected from the group consisting of sodium dodecyl diphenyloxide disulfonate, alkyl aryl sulfate, sodium alkyl sulfate, $C_{16}$–$C_{18}$ potassium phosphate, sodium decyl diphenyloxide disulfonate, and a blend of sodium decyl diphenyloxide disulfonate with condensed naphthalene formaldehyde sodium sulfonate.

4. The soil resist agent of claim 1 wherein the dispersion is an aqueous dispersion.

5. The soil resist agent of claim 1 wherein the polyfluoro organic compound having at least one of a urea, urethane, or ester linkage is the product of the reaction of: (1) at least one organic polyisocyanate containing at least three isocyanate groups, (2) at least one fluorochemical compound which contains per molecule (a) a single functional group having one or more Zerewitinoff hydrogen atoms and (b) at least two carbon atoms each of which contains at least two fluorine atoms, and (3) water in an amount sufficient to react with from about 5% to about 60% of the isocyanate groups in said polyisocyanate.

6. The soil resist agent of claim 5 wherein for the polyfluoro organic compound the amount of water is sufficient to react with abut 10% to about 35% of said isocyanate groups.

7. The soil resist agent of claim 6 wherein said fluorochemical compound which contains a single functional group is represented by the formula:

$$R^f—R_k—X—H$$

in which $R^f$ is a monovalent aliphatic group containing at least two carbon atoms each of which contains at least two fluorine atoms;

R is a divalent organic radical;

k is 0 or 1; and

X is—O—,—S—, or—N($R^1$)— in which $R^1$ is H, alkyl containing 1 to 6 carbon atoms or a $R^f$—$R_k$— group.

8. The soil resist agent of claim 7 wherein $R^f$ is a fully-fluorinated straight or branched aliphatic radical of 3 to 20 carbon atoms which can, be interrupted by oxygen atoms.

9. The soil resist agent of claim 8 wherein X is oxygen and $R_k$ is —$(CH_2)_2$—.

10. The soil resist agent of claim 1 wherein the polyfluoro organic compound having at least one of a urea, urethane or ester linkage is a perfluoroalkyl ester of a carboxylic acid of from 3 to 30 carbon atoms.

11. The soil resist agent of claim 10 wherein the perfluoroalkyl ester is citric acid urethane.

12. The soil resist agent of claim 10 further comprising a non-fluorinated vinyl polymer having an adjusted Vickers Hardness of about 10 to about 20.

13. The soil resist agent of claim 12 wherein the non-fluorinated vinyl polymer is poly(methylmethacrylate).

14. A method of treating fibrous substrates for soil resistance comprising application to the fibrous substrates of a soil resist agent comprising a dispersion in water or water and solvent of a) a polyfluoro organic compound having at least one of a urea, urethane, or ester linkage, and b) at least one anionic non-fluorinated surfactant wherein the anionic surfactant is selected from the group consisting of an alpha olefin sulfonate, salt of alpha sulfonated carboxylic acid, salt of alpha sulfonated carboxylic ester, salt of 1-octane sulfonate, alkyl aryl sulfate, salt of dodecyl diphenyloxide disulfonate, salt of decyl diphenyloxide disulfonate, salt of butyl naphthalene sulfonate, salt of $C_{16}$–$C_{18}$ phosphate, salt of condensed naphthalene formaldehyde sulfonate, salt of dodecyl benzene sulfonate, salt of alkyl sulfate, salt of dimethyl-5-sulfoisophthalate, and a blend of salt of decyl diphenyloxide disulfonate with salt of condensed naphthalene formaldehyde sodium sulfonate, and wherein the ratio of polyfluoro organic compound to surfactant is from about 0.075:1.0 to about 5:1.

15. The method of claim 14 wherein the application is by spray or foam application.

* * * * *